United States Patent [19]

Best et al.

[11] Patent Number: 4,491,370

[45] Date of Patent: Jan. 1, 1985

[54] ROTARY CUTTING ROLLER

[75] Inventors: Gerd Best, Sprockhövel; Norbert B. Weikert, Dortmund, both of Fed. Rep. of Germany

[73] Assignee: Krampe & Co Fertigung in Bergbaubedarf GmbH Zweigniederlassung, Pelkum, Fed. Rep. of Germany

[21] Appl. No.: 526,163

[22] Filed: Aug. 24, 1983

[30] Foreign Application Priority Data

Jan. 15, 1983 [DE] Fed. Rep. of Germany ..... 3301238

[51] Int. Cl.[3] ..... E21C 7/08

[52] U.S. Cl. ..... 299/81; 299/12; 299/87

[58] Field of Search ..... 299/87, 81, 12; 175/339, 340, 393

[56] References Cited

U.S. PATENT DOCUMENTS 3,847,439 11/1974 Allen ..... 299/87 X
4,219,239 8/1980 Weikert et al. ..... 299/81

FOREIGN PATENT DOCUMENTS 1242539 12/1967 Fed. Rep. of Germany .
2032846 1/1972 Fed. Rep. of Germany .
1309005 3/1973 United Kingdom .

*Primary Examiner*—Stephen J. Novosad
*Assistant Examiner*—Michael Starinsky
*Attorney, Agent, or Firm*—Michael J. Striker

[57] ABSTRACT

A cutting roller for a winning machine, which includes a tubular support and a number of helical blades on the tubular support provided with cutting picks arranged on the periphery of each blade, is provided with a hydraulic fluid spraying system which comprises a circumferential fluid distribution passage formed in the blade, connecting passages leading to the spraying nozzles and a radial bridging passage connecting the fluid distribution passage with the connecting passages. The fluid distribution passage and the bridging passage are grooves which accommodate plastic fluid-conducting tubes. The grooves are covered with covers of non-corrosive material which are releasably connected to the walls of the blade.

7 Claims, 6 Drawing Figures

ROTARY CUTTING ROLLER

BACKGROUND OF THE INVENTION

The present invention relates in general to winning machines for winning minerals, coal or the like.

More particularly, this invention pertains to a rotating cutting roller for such a winning machine.

Even more particularly, the present invention relates to a spraying nozzle system operated for suppressing coal dust produced during the winning operation.

It is known that, when a cutting drum provided with a plurality of cutting picks or bits is utilized in the winning machine, spraying nozzles are used for individual picks which spray water onto the picks of the rotating drum to suppress mineral or coal dust produced during the underground mining. Spraying jets applied by the nozzles to the cutting picks are usually so directed that about one third of the free length of the individual pick is stricken by the spraying jet. Thereby the pick is substantially cooled and its service life is increased. The spraying water is normally supplied to the periphery of the cutting drum or roller from the water supply source through the tubular support of the cutting roller. Water is then fed from the tubular support, namely from a special conduit provided in the interior of the tubular support, to fluid distribution channels or passages which are arranged in the foot areas of the helical blade and the locking ring of the cutting roller, adjacently to the outer circumferential surface of the tubular support. Such a fluid distribution passage is usually formed either in the foot area of the locking ring and extends in the circumferential direction of the locking ring or is immediately cut in the foot area of the respective blade and extends according to the shape of the blade in the direction of the outer surface of the tubular support. Individual holes are made in the cutting roller, which extend from the distribution passages to the spraying nozzles. Radial connecting channels or passages formed as deep bores can be also provided in the cutting roller between the fluid distribution passages and the nozzles.

German Offenlegungsschrift No. 2,261,206 discloses a cutting drum for a winning machine, which is provided with a number of helical blades formed of segments. The cutting drum has a fluid distribution channel which extends circumferentially of the respective blade and is radially spaced from the outer surface of the body of the drum. The fluid distribution channels for individual adjacent segments are not connected to each other.

German Offenlegungsschrift No. 2,032,846 describes a cutting roller, in which the fluid distribution channel is formed in the region of the blade, sheltered from the winds, inside of the free edge area of the blade extended transversally to the welded profile iron portion thereof, said channel extending in the circumferential direction of the blade. This fluid distribution channel formed as a conduit is held in position by clamping straps. The disadvantage of this otherwise satisfactory construction is that it has unfavorable loading effect on the blade due to the welded profile iron portion and because of the unfavorable arrangement of the elongated fluid distribution conduit in the area of the outer periphery of the blade, and wherein the clamping straps present a further source of disturbance. The construction expenses in this design are extremely high and thus manufacturing costs are high, respectively. A further disadvantage of the cutting drum described in this German publication is a possibility of blocking of the channel system due to possible corrosive sediments. Furthermore, a multiple coiled fluid supply conduit formed as a hose is provided in this known construction, which should be disposed in the interior of the body of the cutting drum. A similar construction is disclosed in German Pat. No. 1,242,539, this structure being also very expensive.

German Pat. No. 1,272,257 shows a cutting drum or roller in which pick holders extend in the circumferential direction of the blade and are welded to the blade by the fluid distribution conduit formed as a U-iron piece, or are connected to the blade by a weld seam by means of a tubular profile iron piece which in turn is connected, also by welding, to the fluid distribution conduit. This construction is disavantageous in that cracks may be formed in the structure which would lead to leakage in the fluid distribution conduit. Spraying nozzles in this construction direct the spraying jets also unfavorably, namely onto the free spaces rather than onto the picks so that the picks are not properly cooled whereby the service life of these picks is shortened and the picks must be replaced when worn out. The structure is also bulky due to the arrangement of its components on the free periphery of the blade.

British patent specification No. 1,309,005 discloses a rotary cutter for a mineral mining machine, in which water spraying conduits are formed of nylon tubes. The water spraying system of the British disclosure is very complicated and also very expensive in manufacturing.

German patent publication No. 27 25 8726 discloses a cutting roller for a winning machine, in which water spraying system includes a water distribution passage extended circumferentially of the helical blade of the roller, and a radially extended bridging passage to which water or cooling fluid is supplied from a fluid supply passage arranged in the interior of the tubular support of the roller. The fluid spraying system is also provided with connection channels which extend from the fluid distribution passage to individual spraying nozzles. Since the fluid distribution passage is spaced radially outwardly from the outer face of the tubular support forces generated at the weld seam at the foot of the blade act so that they do not unfavorably affect that seam. Furthermore, the manufacturing of such a fluid spraying system presents no problems because the fluid distribution passage is made by milling a groove in the body of the blade. To close such a groove a sheet-like strip formed according to the shape of the groove is provided, which is connected to the body of the blade or the locking ring, if the groove is formed in the latter, by welding. All fluid conducting conduits formed in the cutting roller and including the fluid supply conduit, the fluid distribution conduit and the connection conduits which lead to individual spraying nozzles, have a corrosion-resistant lining or coating to prevent the formation of corrosive sediments on the interior surfaces of the entire fluid channel system. Due to the above arrangement the reliable operation of the whole fluid channel system is warranted. This also results in increase of cutting capacity of the cutting picks and in a longer service life of the picks, particularly in those cases when the whole cutting roller is made out of stainless steel, for example of NIROSTA or a suitable material containing chromium-molybdenium-manganese-nickle-steel.

Apparenty tubes or hoses of synthetic plastic material can be used in the fluid channel system for conducting a spraying fluid; such tubes or hoses should be tightly sealed at the transition or connection zones with each other by clamping straps. The cutting rollers in which such tubes can be utilized have the advantage that the whole channel system is protected against corrosion. However, even this structure has the disadvantage which resides in that it requires repair and cleaning of the interior of the channel system due to corrosion of covering strips and shields which are welded to the body of the blade or the locking ring. These repair and cleaning operations are bothersome and costly and should be usually carried out at work side.

SUMMARY OF THE INVENTION

It is an object of the invention to provide an improved cutting roller for a winning machine.

It is a further object of this invention to provide a rotary cutting roller with an improved water-spraying system.

It is still another object of the invention to provide a cutting roller with a fluid channel system having fluid passages with corrosion-resistant coating, particularly with a fluid distribution passage and connection passages leading to the individual nozzles, formed with such a coating, and in which passages tubes or hoses of synthetic plastic material are disposed which are connected to each other clamping straps and short transition sleeves whereby a required repair or cleaning of the fluid channel system can be carried out fast and without any problems.

These and other objects of the invention are attained by a cutting roller for a winning machine, comprising an elongated tubular support; at least one helical blade provided on a circumferential surface of said support; a locking ring connected to said tubular support at one end thereof, said blade and said locking ring each having side walls and a periphery and each being provided with a plurality of pick holders on said periphery for receiving cutting picks therein; spraying nozzles located on said blade and said locking ring near said pick holders and each being assigned to a respective pick holder for spraying a hydraulic fluid on the respective pick; at least one fluid supply passage means formed in said tubular support for said blade and said locking ring; fluid distribution passage means formed in said blade and extended circumferentially thereof and also formed in said locking ring; a plurality of connecting channels for connecting said fuid distribution passage means to individual spraying nozzles, said fluid distribution passage means being radially outwardly spaced from the outer circumferential surface of said tubular body towards said spraying nozzles, said fluid distribution passage means including a first circumferential groove formed in the side wall of said blade and a second circumferential groove formed in the side wall of the locking ring, said first and second grooves being closed with respective covers; bridging passage means for connecting the fluid supply passage means to said fluid distribution passage means, said bridging passage means including a third radially extended groove formed in the side wall of said blade, said third groove being closed with a cover, said covers for said first and second grooves and said cover for said third groove being detachably connected to the blade and to the locking ring, respectively, and being made of non-corrosive material.

In the cutting roller according to the invention the covers which close the fluid passages, for example the fluid distribution passage, are connected to the respective blade or the locking ring in such a manner that no corrosion due to operation with a spraying fluid occurs on the blade, or the locking ring or the tubular support; these covers can be easily detached from the respective components of the cutting roller and also easily connected to them.

When the respective cover is removed from the blade or the locking ring and the plastic hose located in the respective groove is exposed, the operator can easily exchange the hose or the tube, after releasing the clamping straps, if desired.

The channel system according to the invention makes possible an easy cleaning of the entire fluid-conducting system.

The covers may be screwed to the respective walls of said blade and said locking ring by bolts. This structure is particularly advantageous for operation in underground mines.

Furthermore, the covers may be clamped to the respective walls of said blade and said locking ring. Small hand grips can be used to detach the covers from those walls and bring them again to a closed position.

The covers may be also connected to the respective walls of said blade and said locking ring by hinges.

The covers may be formed as sheet-like strips, or profiled iron-pieces or as segments connected to each other. The last construction is suitable particularly for specifically shaped fluid distribution channels when such a channel is divided along its length into a plurality of individual portions which are easy to handle.

The hinge-like structure includes covers which are pivotally connected to the respective wall of the blade or the locking ring and may be secured to that wall in the closed position, for example by screws.

The fluid distribution passage means may further include a tubular conduit made of synthetic plastic material and located in said first groove, said connecting channels being each formed of a tubular conduit of synthetic plastic material, said first mentioned tubular conduit being connected to the tubular conduit of the respective connecting channel by a T-shaped connecting member.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
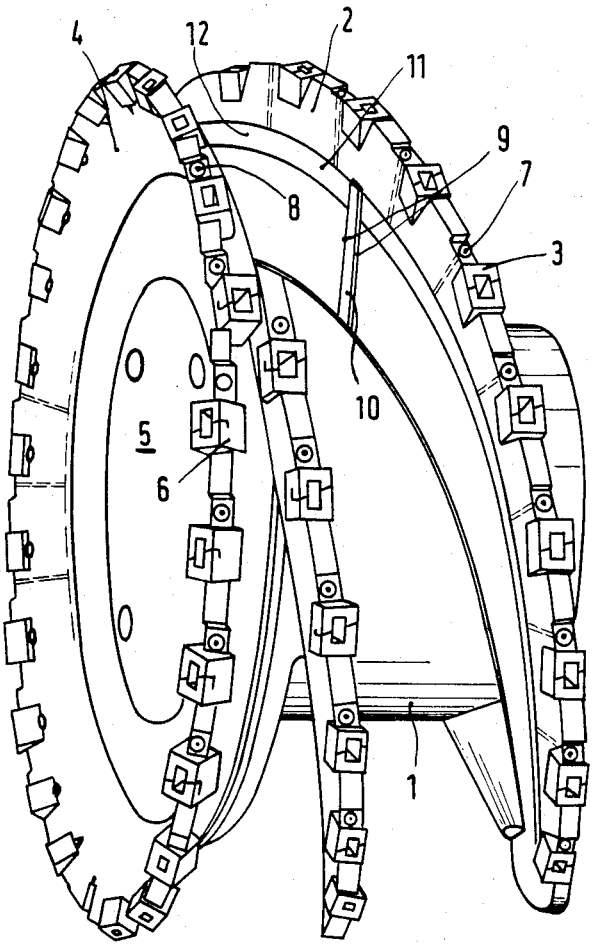
FIG. 1 is a perspective view of a cutting roller with cutting picks omitted, according to one embodiment of the invention.

Referring now to FIG. 1, reference character 1 denotes a tubular support, on the outer surface of which a helical blade 2 is arranged. This blade extends radially outwardly from the outer surface of support 1 and has a helically formed plate-like configuration. A number of identical blades axially spaced from each other and disposed at a predetermined angle of inclination to the periphery of support 1 can be provided on the cutting roller. Each blade is, at its foot region, rigidly connected, for example welded, to the outer surface of support 1. Reference numeral 4 designates a locking ring the annular portion of which, which is conically open towards the working face, is also rigidly connected to support 1. The blade 2 as well as the locking ring 4 are provided at the outer periphery thereof with a plurality of pick holders 3 and 6 which are circumferentially spaced from each other an equal distance. Each pick holder carries in the known manner a cutting pick (not shown herein) which extends outwardly away from the respective pick holder, to perform cutting of the material, e.g. mineral.

The cutting roller according to the invention can be particularly suitable for use in underground mining with winning machines.

It is to be understood that the locking ring 4 and blade 2 each have similar constructions in the both illustrated embodiments of the invention. Locking ring 4 is also connected to the support 1 by welding and is of the structure known in the art.

Reference numeral 5 denotes a cover which closes the cutting roller in the direction of the working face.

Figure 2:
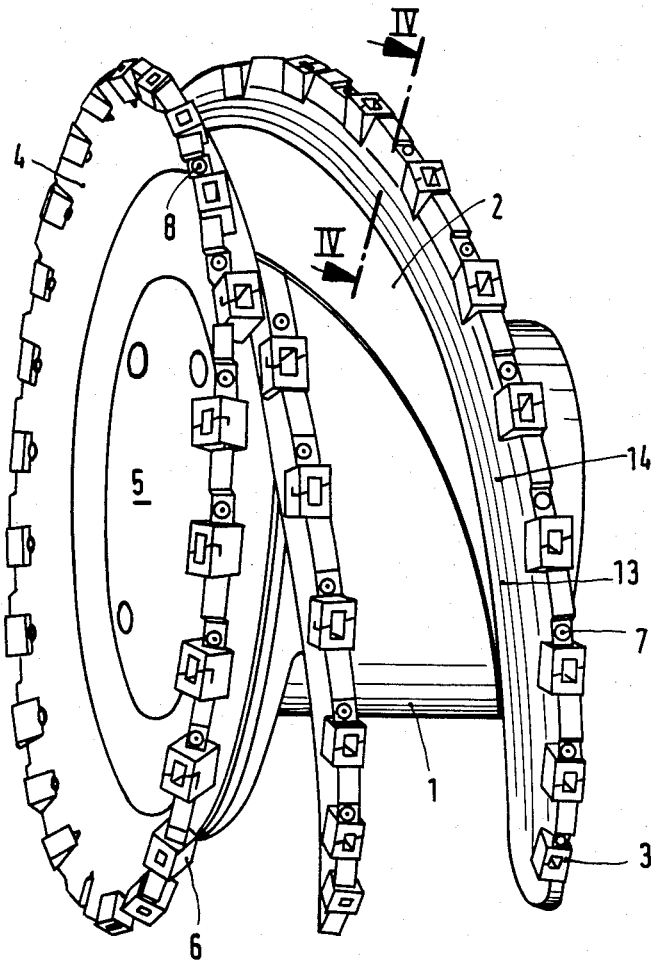
FIG. 2 is a perspective view of the cutting roller, also with the cutting picks not illustrated, according to a further embodiment of the invention.

As shown further in FIGS. 1 and 2, a number of spray nozzles 7 or 8 are provided on the blade 2 or locking ring 4, each of which corresponds to the respective pick holder 3 or 6. Spray nozzles 7 and 8 are formed near respective pick holders to spray water onto the cutting picks at a predetermined angle. The water spray or jet from the nozzles is so directed that it strikes against the upper or third portion of the respective pick so that the latter is cooled and damage to a hard metal solder on the picks due to their overheating will be prevented. Thereby a service life of the cutting picks is significantly increased. Due to the sprays of water applied to all the picks the cutting roller is surrounded with a spray mist and dust produced during the mining becomes suppressed. Therefore such cutting rollers do not contaminate the environment.

The constructions in which an individual nozzle corresponds to each individual pick is known as "an individual nozzle system".

A fluid supply passage or a fluid feeding passage is formed in the known manner in the interior of the tubular support 1. Such a passage is not shown in the drawing. A special respective tube or a conduit which is connected to that fluid supply passage by means of a nipple or the like leads to the fluid distribution passage and from there to the respective blade 2 or the locking ring 4 in the manner described herein below.

In the embodiment illustrated in FIG. 1 a radially extended bridging conduit 9 is provided, which can be formed by a groove cut in the side wall of blade 2. In the embodiment depicted in FIG. 2 the connection is effected by means of one or more radially extended holes formed in the blade 2 which are also connected to the fluid supply passage. Such holes are not shown in the drawings for the sake of simplicity. Similar holes are formed in the locking ring to conduct water from the fluid supply passage to the periphery of the locking ring. The bridging conduict 9 is closed by a sheet metal strip 10.

Reference character 11 designates a distribution passage which extends in the circumferential direction of blade 2 and is uniformly spaced in the radial direction from the outer surface of tubular support 1. Distribution passage 11 is also closed by one or several sheet metal strips 12. Distribution passage 11 is formed as a recess or groove cut or milled in the side wall of blade 2.

In the embodiment of FIG. 2 a distribution passage 13 is provided, which is arranged similarly to the distribution passage 11 of FIG. 1 and closed or covered by a sheet-like strip 14.

Strips 10, 12 and 14 are connected to the body of the blade by screws or bolts so that they can be removed from the blade without any problem. The distribution passage 13 of the embodiment of FIG. 2 also formed as a groove or recess in the wall of blade 2 is connected to one or more fluid supply passages (not shown). Each distribution passage 11 or 13 is in turn in communication with a respective connection passage or channel 28 which leads to a respective nozzle-receiving member and thus to a respective nozzle, for example nozzle 7 to supply the latter with a spraying hydraulic fluid.

Figure 3:
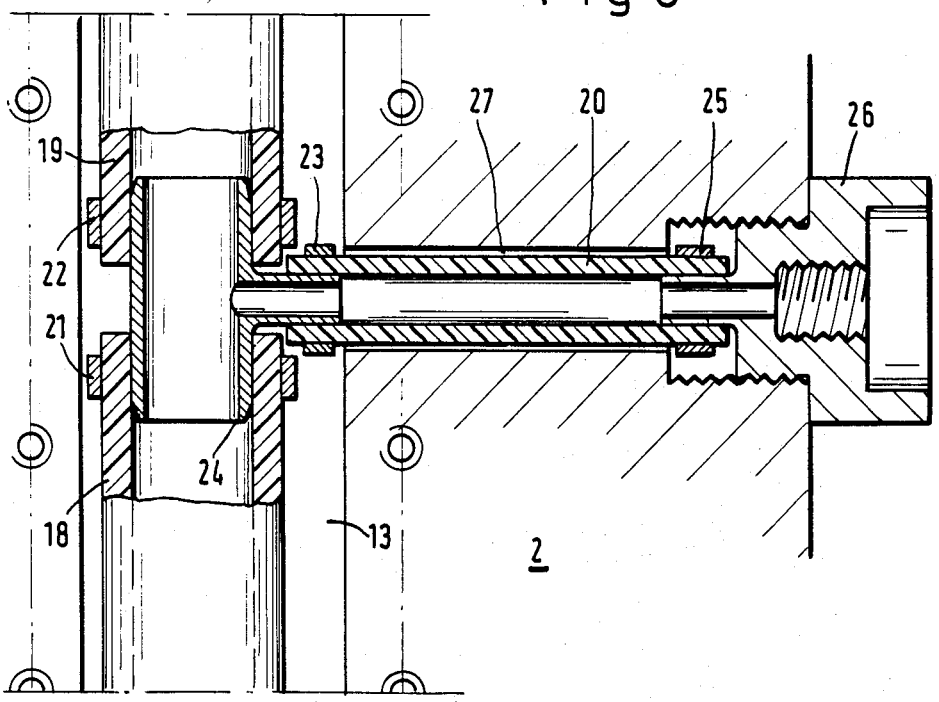
FIG. 3 is a sectional view along the line III—III of FIG. 4.
Figure 4:
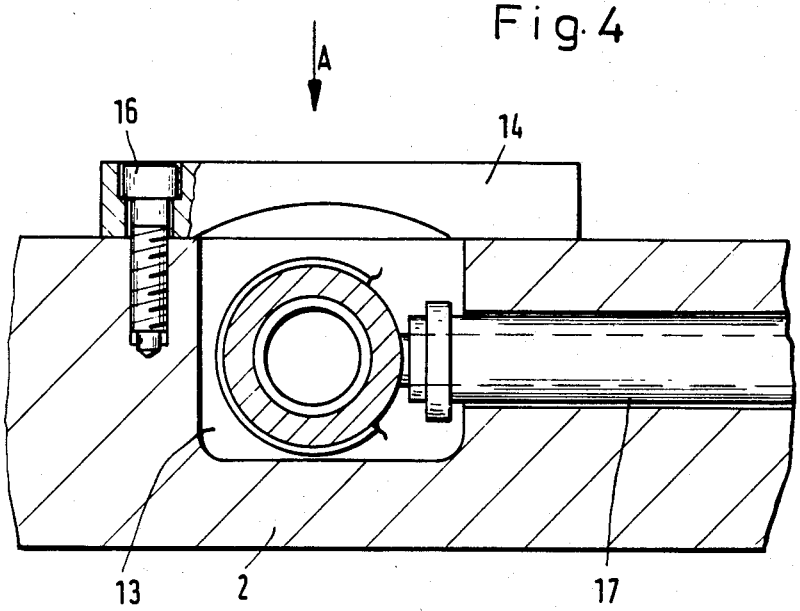
FIG. 4 is a view, partially in section, along the line IV—IV of FIG. 2.

With reference to FIGS. 3 and 4 which show details of FIG. 2 it is shown that the distribution passage 13 is formed as a groove or recess cut in the back side wall of blade 2. This groove is closed along the length thereof with sheet-like strip 14 which is secured to the body of blade 2 by bolts 16 (only one bolt 16 is shown in FIG. 4). A tubular conduit 17 extends from the passages which lead to the spray nozzles, for example nozzle 7.

The conduit system shown in FIGS. 3 and 4 is formed of hoses or tubes of synthetic plastic material which has considerable flexibility. Tubes 18 and 19 of synthetic plastic material, which are connected to each other, form the distribution conduit located in the recess 13 and the tube or hose 20 of synthetic plastic material forms the conduit 17.

Tubes 18 and 19 are connected to each other and to the tube 20 by a T-like element 24 extended with its portions into and engaged in openings of tubes 18, 19 and 20, respectively. Clamping straps 21, 22, 23 hold the ends of the tubes connected to each other in the fixed position. Clamping straps 21, 22, 23, 25 can be metallic whereas the T-shaped connection member 24 can be made out preferably of a corrosion-resistant synthetic plastic material suitable for operation underground and with minerals being or of stainless steel.

The end of plastic tube 20 overlaps the connection nipple of a nozzle-receiving member 26. The clamping strap 25 is arranged at the end of tube 20, which end receives an axial projection 30 formed on the nozzle-receiving member 26. Thus clamping strap 25 clamps the tube 20 on the nozzle-receiving member.

As can be understood the conduit system according to the invention can be easily exposed for cleaning or repair merely by removing sheet-like strips 14 and without disassembling of one or more plastic tubes. After required cleaning or repair cover strips 14 can be again mounted to their closed position. In the system of the invention therefore, no components subjected to corrosion are used.

The cover strips 10, 14 can be clamped to the blade by any suitable means.

Figure 4A:
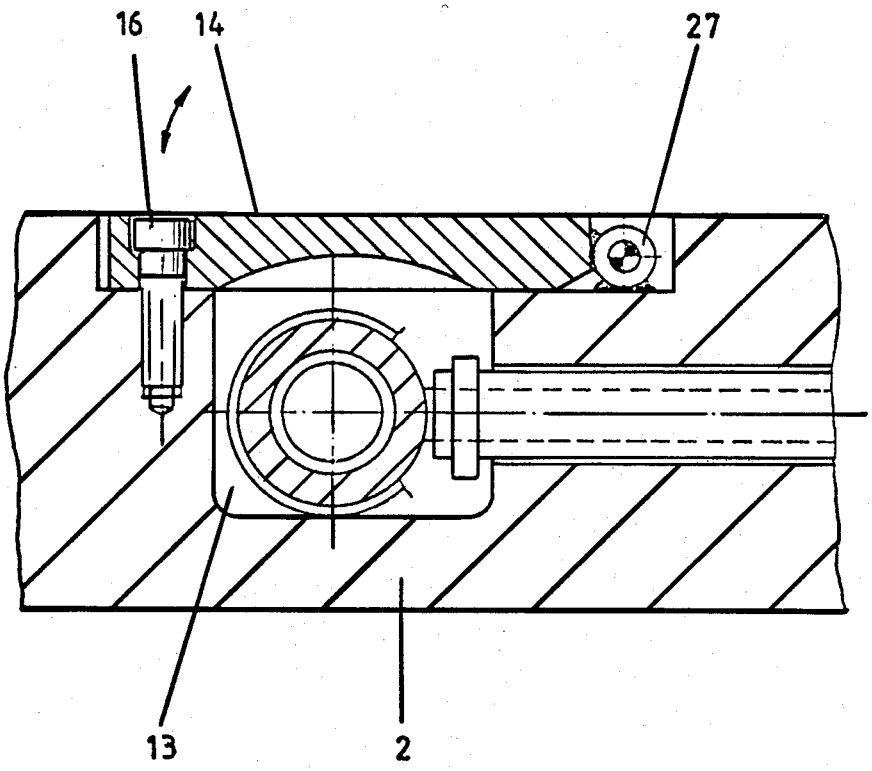
FIG. 4*a* is a view similar to that of FIG. 4 but with the cover strip connected to the blade by a hinge.
Figure 4B:
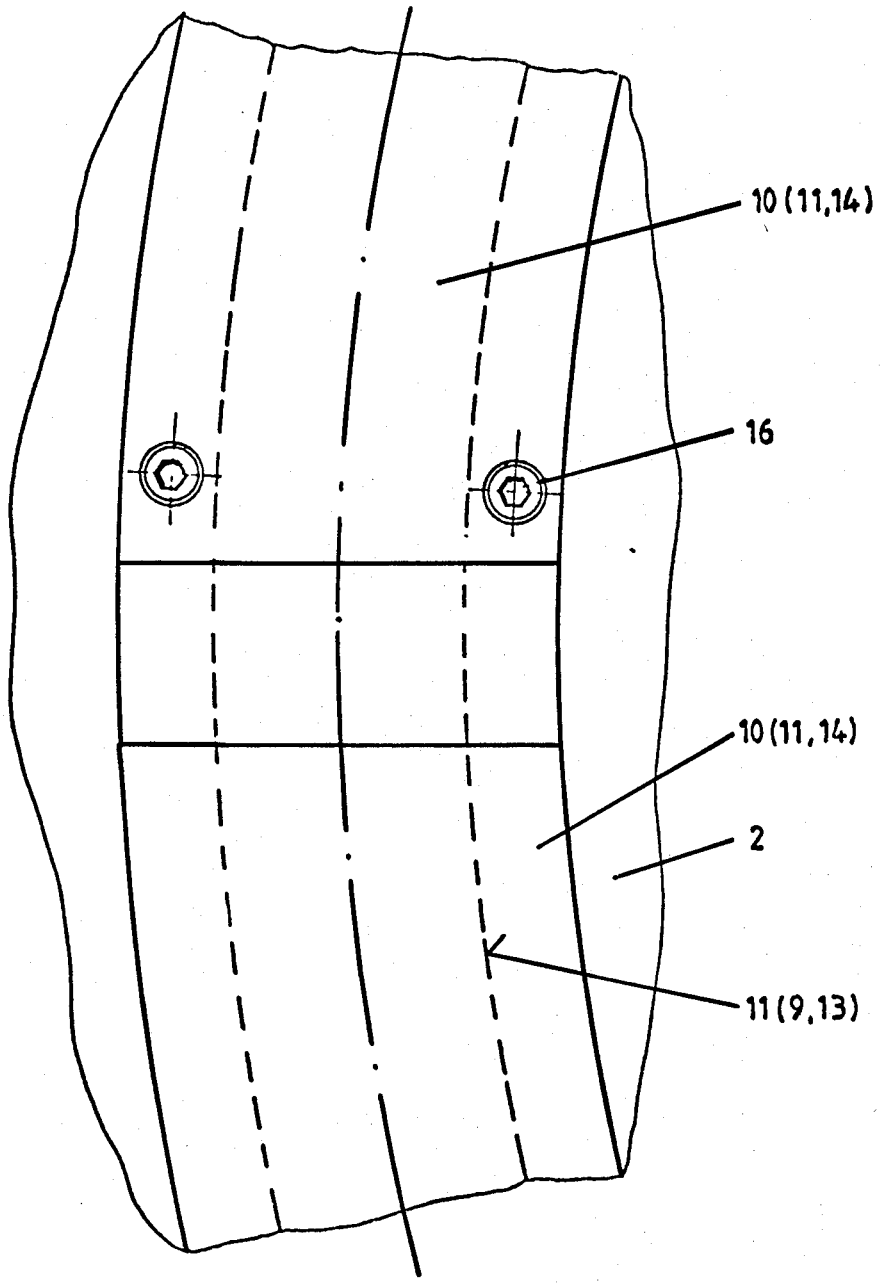
FIG. 4*b* shows the cover formed of a number of segments.

The cover strips 10, 14 can be formed not only as sheet-like strips, but also made out of a profile iron or made of segments a shown in FIG. 4*b*.

Furthermore, it is possible to connect the cover strips 10, 14 to the blade 2 or locking ring 4 by a hinge 27, as shown in FIG. 4*a*, so that they can swing to and from the blade or locking ring.

It is to be understood that similar fluid distribution circumferential passages as well as radially extended bridging passages are provided in the side wall of the blade 2 and in the back side wall of the locking ring 4 for supplying hydraulic fluid to the respective spraying nozzles.

It will be understood that each of the elements described above, or two or more together, may also find a useful application in other types of cutting rollers differing from the types described above.

While the invention has been illustrated and described as embodied in a cutting drum, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A cutting roller for a winning machine, comprising an elongated tubular support; at least one helical blade provided on a circumferential surface of said support; a locking ring connected to said tubular support at one end thereof, said blade and said locking ring each having side walls and a periphery and each being provided with a plurality of pick holders on said periphery for receiving cutting picks therein; spraying nozzles located on said blade and said locking ring near said pick holders and each being assigned to a respective pick holder for spraying a hydraulic fluid on the respective pick; at least one fluid supply passage means formed in said tubular support for said blade and said locking ring; fluid distribution passage means formed in said blade and extended circumferentially thereof and also formed in said locking ring; a plurality of connecting channels for connecting said fluid distribution passage means to individual spraying nozzles, said fluid distribution passage means being radially outwardly spaced from the outer circumferential surface of said tubular body towards said spraying nozzles, said fluid distribution passage means including a first circumferential groove formed in the side wall of said blade and a second circumferential groove formed in the side wall of the locking ring, covers for closing said first and second grooves, respectively; bridging passage means for connecting the fluid supply passage means to said fluid distribution passage means, said bridging passage means including a third radially extended groove in the side wall of said blade, a cover for closing said third groove, said covers for said first and second grooves and said cover for said third groove being made of non-corrosive material and means releasably connecting said cover to the blade and to the locking ring, respectively so as to enable an easy opening of and an access to each of said grooves from outside for cleaning or repairing each of said passage means.

2. The cutting roller as defined in claim 1, wherein said covers are connected to the respective walls of said blade and said locking ring by bolts.

3. The cutting roller as defined in claim 1, wherein said covers are connected to the respective walls of said blade and said locking ring by hinges.

4. The cutting roller as defined in claim 1, wherein said covers are formed of sheet-like strips.

5. The cutting roller as defined in claim 1, wherein said covers are formed of profiled iron.

6. The cutting roller as defined in claim 1, wherein said covers are formed of segments.

7. The cutting roller as defined in claim 1, wherein said fluid distribution passage means each further including a tubular conduit made of synthetic plastic material and located in said first groove, said connecting channels each including a tubular conduit of synthetic plastic material, said first mentioned tubular conduit being connected to the tubular conduit of the respective connecting channel by a T-shaped connecting member.

* * * * *